US008978774B2

(12) United States Patent
Fossli et al.

(10) Patent No.: US 8,978,774 B2
(45) Date of Patent: Mar. 17, 2015

(54) SYSTEM AND METHOD FOR DRILLING A SUBSEA WELL

(75) Inventors: Borre Fossli, Oslo (NO); Sigbjorn Sangesland, Tiller (NO)

(73) Assignee: Ocean Riser Systems AS, Oslo (NO)

( * ) Notice: Subject to any disclaimer, the term of this patent is extended or adjusted under 35 U.S.C. 154(b) by 333 days.

(21) Appl. No.: 13/508,579

(22) PCT Filed: Nov. 10, 2010

(86) PCT No.: PCT/EP2010/067169

§ 371 (c)(1),
(2), (4) Date: May 8, 2012

(87) PCT Pub. No.: WO2011/058031

PCT Pub. Date: May 19, 2011

(65) Prior Publication Data

US 2012/0227978 A1 Sep. 13, 2012

(30) Foreign Application Priority Data

Nov. 10, 2009 (NO) ..... 20093309

(51) Int. Cl.
*E21B 33/06* (2006.01)
*E21B 21/08* (2006.01)
(Continued)

(52) U.S. Cl.
CPC ..... *E21B 21/08* (2013.01); *E21B 21/001* (2013.01); *E21B 43/38* (2013.01)
USPC ..... 166/363; 166/347; 175/5

(58) Field of Classification Search
CPC ..... E21B 21/001; E21B 21/08
USPC ..... 175/5, 25, 38; 166/357, 367, 364, 347, 166/341
See application file for complete search history.

(56) References Cited

U.S. PATENT DOCUMENTS 4,046,191 A * 9/1977 Neath ..... 166/352
4,813,495 A * 3/1989 Leach ..... 175/6
5,848,656 A * 12/1998 M.o slashed.ksvold ..... 175/7
(Continued)

FOREIGN PATENT DOCUMENTS

EP 1519002 A1 3/2005
WO 03/023181 A1 3/2003
(Continued)

OTHER PUBLICATIONS

Search Report for Norwegian Patent Application No. NO 20093309, dated May 27, 2010, 2 pages.
(Continued)

*Primary Examiner* — James G Sayre
(74) *Attorney, Agent, or Firm* — Maine Cernota & Rardin

(57) ABSTRACT

A subsea mud pump can be used to return heavy drilling fluid to the surface. In order to provide a less stringent requirement for such a pump and to better manage the bottom hole pressure in the case of a gas kick or well control event, the gas should be separated from the drilling fluid before the drilling fluid enters the subsea mud pump and the pressure within the separating chamber. The mud pump suction should be controlled and kept equal or lower than the ambient seawater pressure. This can be achieved within the cavities of the subsea BOP by a system arrangement and methods explained. This function can be used with or without a drilling riser connecting the subsea BOP to a drilling unit above the body of water.

26 Claims, 7 Drawing Sheets

(51) Int. Cl.
*E21B 21/00* (2006.01)
*E21B 43/38* (2006.01)

(56) References Cited

U.S. PATENT DOCUMENTS 6,276,455 B1 * 8/2001 Gonzalez ..... 166/357
2003/0205384 A1 11/2003 Lush et al.

FOREIGN PATENT DOCUMENTS

WO 2007/032687 A1 3/2007
WO 2009/123476 A1 10/2009

OTHER PUBLICATIONS

PCT Search Report for PCT Application No. PCT/EP2010/067169, dated Sep. 8, 2011, 2 pages.

* cited by examiner

SYSTEM AND METHOD FOR DRILLING A SUBSEA WELL

TECHNICAL FIELD

The present invention relates to the field of oil and gas exploitation, more specifically to systems and methods for well control, especially for well pressure control in wells with hydrocarbon fluids, as defined in the enclosed independent claims.

BACKGROUND ART

Drilling for oil and gas in deep waters or drilling through depleted reservoirs is a challenge due to the narrow margin between the pore pressure and fracture pressure. The narrow margin implies frequent installation of casing, and restricts the mud circulation due to pressure drop in the annulus between the wellbore and drill string or in other words the increase in applied or observed pressure in the borehole due to the drilling activity such as circulation of drilling fluid down the drill pipe up the annulus of the well bore. Reducing this effect by reducing the circulating flow rate, will again reduces drilling speed and causes problems with transport of drill cuttings in the borehole.

Normally, in conventional floating drilling with a marine drilling riser installed, two independent pressure barriers between a formation possibly containing hydrocarbons and the surroundings are required. In conventional subsea drilling operations, normally, the main (primary) pressure barrier is the hydrostatic pressure created by the drilling fluid (mud) column in the borehole and drilling riser up to the drilling installation. The second barrier comprises the Blow-Out Preventer (BOP) connected to the subsea wellhead on seabed.

A conventional drilling system is shown in FIG. 1*a*.

If a formation is being drilled where the hydrostatic pressure of the drilling fluid is not sufficient to balance the formation pore pressure, an influx of formation fluids that may contain natural gas could enter the wellbore. The primary barrier is now no longer effective in controlling or containing the formation pore pressure. In order to contain this situation, the subsea Blow Out Preventer (BOP) must be closed. In a conventional drilling system the oil and gas industry has developed certain standard operational well control procedures to contain the situation for such an event. These are well established and known procedures and will here only be described in broad general terms.

FIG. 1*a* illustrates a conventional subsea drilling system. If the pressure in the borehole 1 due to the hydrostatic pressure from the drilling fluid is lower than the pore pressure in the formation being drilled, an influx into the well bore might occur. Since the density of the influx is lower (in most cases) than the density of the drilling fluid and now occupy a certain height of the wellbore, the hydrostatic pressure at the influx depth will continue to decrease if the well can not be shut in using the BOP. By shutting in the well by closing one of several elements 15*a, b, c, d*, 16 in the subsea BOP stack 3 and trapping a pressure in the well 14, the influx from the formation can be stopped (see FIG. 1*b*). The procedures of containing this situation and how the influx is circulated out of the well by pumping drilling fluid down the drillstring 8 out of the drillbit 10 and up the annulus of the wellbore 14 is well established. The valves in the choke line 25 is opened on the subsea BOP to the high pressure (HP) choke line 24 and the bottom hole pressure controlled by the adjustable choke 22 on top of the coke line on the drilling vessel above the body of water. Downstream the adjustable choke valve, the well stream is directed to a mud-gas separator 42. This is a critical operation, particularly in deep water areas as there are very narrow margins as to how high the surface pressure upstream the surface choke can be before the formation strength is exceeded in the open hole section.

Floating drilling operations are often more critical compared to drilling from bottom supported platforms, since the vessel is moving due to wind, waves and sea currents. This means that the floating drilling vessel and the riser may be disconnected from the subsea BOP and wellbore below. If heavier than seawater drilling fluid is being used, this will result in a hydrostatic pressure drop in the well. Generally, a riser margin is required. A riser margin is defined as the needed density (specific gravity) of the drilling fluid in the borehole to over-balance any formation pore pressure after the drilling riser is disconnected from the top of the subsea BOP near seabed in addition to the seawater pressure at the disconnect point 20. When disconnecting the marine drilling riser from the subsea BOP, the hydrostatic head of drilling fluid in the bore hole and the hydrostatic head of sea water should be equal or higher than the formation pore pressure (FPP) to achieve a riser margin. Riser margin is difficult to achieve, particular in deep waters. The reason is that there can be substantial pressure difference between the pressure inside the drilling riser due to the heavy drilling fluids and the pressure of seawater outside the disconnect point on the riser. To compensate for the pressure reduction in the open hole falling below the pore pressure when the riser is disconnected, would require drilling with a very high mud weight in the well bore and riser. So when drilling with this heavy mud weight all the way up to the spill point on the rig 5, normally being between 10 to 50 m above sea level, the bottom hole pressure would be higher than the formation strength is able to support. Hence the formation strength would be exceeded and mud losses would occur. It would no longer be possible to circulate and transport the drill cuttings out of the borehole and the drilling operation would have to stop.

Riser Less Drilling, Dual Gradient Drilling and drilling with a Low Riser Return System (LRRS), have been introduced to reduce some of the above mentioned problems. The LRRS is described in, e.g., WO2003/023181, WO2004/085788 and WO2009123476, which all belong to the present applicant.

In dual gradient (DG) drilling systems a high density drilling fluid is used below a certain depth in the borehole, with a lighter fluid (for example sea water or other lighter fluid) above this point. When drilling with a riser, a dual gradient effect could be achieved by diluting the drilling riser contents with a gaseous fluid for example, or another lighter liquid, U.S. Pat. No. 6,536,540 (de Boer). Another method could be to install a pump on the seabed or subsea and keep the riser content full or partially full of seawater instead of mud while the returns from the well bore annulus is pumped from seabed up to the drilling installation in a return path external from the main drilling riser. Hence there are two different density liquids in addition to the atmospheric pressure creating the hydrostatic pressure on the underground formation. References are made to prior art, U.S. Pat. No. 4,813,495 (Leach) and U.S. Pat. No. 6,415,877 (Fincher et. al.).

Another technology that could create a riser margin is the single mud gradient, Low Riser Return System (LRRS) belonging to the applicant. Here, a pump is placed somewhere between the sea level and sea bed and connected to the drilling riser. The drilling mud level is lowered to a depth considerable below the sea level. Due to the shorter hydrostatic head (height) of the drilling fluid acting on the open hole formation, the density of the drilling mud could be increased without exerting excess pressure acting on the formation. If this heavy drilling mud was carried all the way back to the drilling rig, as the case would be in a conventional drilling operation, the hydrostatic pressure would exceed the formation strengths, and hence mud losses would occur.

In riserless drilling, there is simply not a riser installed hydraulically connecting the seabed installed BOP to the drilling rig trough a marine drilling riser. Normally, the top of the wellbore (subsea BOP) is kept open to seawater pressure during drilling; hence the hydrostatic wellbore pressure is made up of the seawater pressure acting on the well at seabed, plus the hydrostatic pressure of the drilling fluid in the well below this point, also described in U.S. Pat. No. 4,149,603 (Arnold).

Several other concepts have been introduced and are in the public domain.

Other systems have introduced a closing element on top of the subsea BOP that can isolate the seawater pressure at seabed from acting on the borehole annulus (U.S. Pat. No. 6,415,877). Such closing element could be a so called Rotating Control Device (RCD) or a rotating BOP. These are somewhat different from an annular preventer in that it is possible to rotate the drill string while sealing pressure from below or above (seawater). It is not recommended practice to rotate the drillstring while a conventional annular BOP is closed during drilling due to excess wear on the rubber element. If such a system is used in combination with a subsea mudlift pump at seabed or mid sea, the suction pressure of the mud pump below the RCD in addition to the drilling fluid height and dynamic pressure loss in the annulus, directly control the pressure in the borehole.

Common for all these drilling systems is that the drilling fluid returning from the well cannot be returned through high pressure choke or kill lines in a conventional manner due to limited formation strength when the BOP is closed after an influx has occurred. Due to the heavy mud weight required or used, this mud will be displaced out of the wellbore annulus ahead of the lighter influx, hence the formation strength cannot support to be hydraulically in contact with the surface installation when the annulus of the wellbore and the conduit (kill or/and choke lines) back to surface are filled with the heavy drilling fluid. This effect will restrict the use of earlier systems or will put severe strain and requirement on the equipment and processes in a well control event.

In dual Gradient Drilling and riserless drilling, many types of Subsea Lift Pumps (SLP) can normally not handle a significant amount of gas from the well, as the case may be in a well control event for a gas kick. There are several reasons for this. In normal operations these pumps must handle a significant amount of drill cuttings and rocks in addition to the fine solid particles of the weight materials used in the drilling mud. If a gas influx is introduced into the wellbore at a considerable depth and pressure, this gas will expand when circulated up the bore hole to the seabed or mid-ocean where the pump is located. If this return path of fluids from the well has to go directly into the pump, it will put severe strain on the pump system.

Secondly, the bottom hole pressure will be a direct function of the fluid head in the annulus, the dynamic pressure loss in the annulus and the pump suction pressure. It will be extremely difficult to achieve a stable and controllable suction pressure on the pump when you will have slugs of high concentration hydrocarbon gas flowing directly into the pump system. As a consequence it will be a great advantage if the hydrocarbon gas and drilling fluid could be separated from each other subsea, before liquid drilling fluid and solids being diverted and pumped to surface by the subsea pump. This was also envisioned by Gonzales in U.S. Pat. No. 6,276,455.

Thirdly as the subsea pump in earlier systems is in direct communication with the annulus, the return lines and the pump system must be of the same high pressure rating as the BOP itself. This put severe requirements on the pump system to handle internal pressures.

Subsea Choke Systems.

Prior art exists in an attempt to compensate for the excessive pressure in the borehole acting on the well when circulating out a kick in a conventional manner through high pressure small bore choke line and a surface choke on the upper part of this line. U.S. Pat. No. 4,046,191 (Neath) and U.S. Pat. No. 4,210,208 (Shanks) introduced a surface controlled subsea choke where the flow from below a closed Subsea BOP was directed into the main bore of the drilling riser through a subsea choke.

Neath envisioned a conventional drilling system where the riser was full of conventional weighted drilling fluid. If such a system was used in a situation where dual gradient drilling technology was used, the pressure on the downstream of the adjustable choke could become too high due to the high mud weight used. Also since the riser was initially full of drilling mud, gas introduced into the base of the riser at great water depth could introduce further problems since the riser have limited collapse and internal pressure ratings.

SUMMARY OF THE INVENTION

In order to overcome challenges with prior art in conducting well control operations during riserless drilling and other dual gradient drilling technology, a method of controlling wellbore pressure in a controlled fashion will be explained.

Several alternatives for creating a subsea separation system within a subsea BOP will be explained below. Reference numbers refer to the accompanying drawings, as examples only.

Subsea BOP Gas Separation System

A riser joint used may be particularly designed to function as a separator where the separated gas is vented to the surface via the riser and the liquid is pumped to the surface via an exterior return path from the main drilling riser (FIG. 2 and FIG. 3). The main difference here with prior art is that the mud/liquid level in the riser is controlled and located at a considerable level below the sea level. In this fashion it is prevented that drilling fluids or liquids will be unloaded from the top of the riser if gas is being released into the base of the riser.

In another embodiment, a BOP extension joint (BOP-EJ) located between lower and upper annular preventer is so designed that with 2 different BOP elements closed, a chamber or cavity will be formed where gas can be separated from liquids by gravity and the separated gas vented via a conventional choke line or a separate conduit line, or alternatively via a riser to the surface. The liquid is pumped to the surface by the subsea mud pump controlling the liquid level in the cavity.

Another alternative would be a separate unit for separation where the separated gas is vented via a conventional choke line and the liquid is pumped to the surface through a separate liquid conduit line (not shown here).

A representation of a new riserless drilling system is shown in FIG. 4. In this system a subsea mud pump 11 is installed on seabed or some distance above and hydraulically connected to the well so that the drilling fluid and drill cuttings are pumped up to the drilling installation in a separate return flow path 12. The interphase between the drilling fluid and the seawater is then somewhere in the vicinity of the Subsea BOP.

BOP-Extension Joint vs. Riser Joint for Mud/Gas Separation

A conventional subsea BOP is normally equipped with two annular preventers on modern rigs. The lower annular preventer 16 in FIG. 1*a* is normally the uppermost closing element in the lower BOP stack 3 which consists of a series of ram type preventers stacked on top of each other 15 *a, b, c, d* and the said BOP stack 3 installed with a special connector either to a High Pressure Wellhead (HP WH) 52 or a Horizontal Christmas-Tree (HXT) (not shown here). The total height of the lower subsea BOP is in the vicinity of 7 to 10 meter. The height of the HP WH is approximately 1 meter. The HP WH is normally installed on what is defined as the surface casing which normally sticks 2-3 meter above the seabed. The upper annular preventer 19 is normally installed in what is termed the Lower Marine Riser Package (LMRP). However, some rigs may have both annular preventers above the riser BOP disconnect point 20, FIG. 1*b*, in the LMRP. The interface between the lower BOP stack and the LMRP is normally designed a hydraulic remote operated disconnect point between the lower marine riser package (riser) and the lower subsea BOP. Hence the distance between the lower annular preventer on the BOP and the upper annular preventer in the LMRP is normally approximately 1.5-2.5 meters. In order to create a longer distance between the 2 annular preventers an extension joint could be installed to create more space.

If the mud and gas could be separated in a BOP cavity and/or BOP Extension Joint thereby creating a gas phase in the upper part of the BOP, this would allow a surface choke to control the gas pressure if connected to the cavity between the two closing elements, hydraulically either by flexible or fixed lines (no gas vent through riser).

BOP-Extension Joint can then be used for fluid-mud/gas separation in drilling with and without the riser.

If and when using the Low Riser Return System in another embodiment of this invention, the upper annular preventer can be closed during a drill pipe connection to avoid fluid level adjustment in the riser where in this case, the fluid level in the choke line is used to control and regulate the annulus pressure in order to compensate for the equivalent circulating density (ECD) effect (time saving). This is also explained in WO2009/123476, belonging to the applicant. The downside of having the liquid separated from the gas close to seabed as opposed to higher up in the riser is the longer pump suction line needed in deep water and the higher differential pressure capacity of the subsea pump system.

Another feature of this arrangement is the possibility to control bottom hole pressure while drilling (lower annular open) and when circulation out a well kick (lower annular closed), by controlling the liquid mud level in the choke line (subsea choke fully open) (FIG. 6). In this case the upper annular could be substituted with a rotating BOP (RBOP or RCD) 19 where the mud pressure in the borehole annulus 1 is regulated by the liquid mud level in the choke line 51 (FIG. 6). The pressure in the BOP and or BOP extension is now a function of the liquid level 51 in the choke line and the gas/air pressure above. This gas can either be ventilated to atmospheric pressure or controlled and regulated by the surface choke 22. This will create a softer and more dynamic process than having the pump suction pressure (only liquid) directly controlling the wellbore pressure. When low compressibility liquid is contained in a closed loop system, it will create a very stiff system. Small changes will affect well bore pressure immediately, while a level control of drilling fluid, mud and/or seawater in the choke line will be a slower and more controllable process.

While drilling, this could set up a unique method of pressure control. An influx into the borehole between the open hole and drillstring could have a self regulating effect. An influx into the wellbore has a density higher than air in top of the choke line and for the case of example 8½" hole and 6" drill collars would have a capacity of minimum 17.8 liter per meter hole section. The capacity of most choke lines (3"-5) is between 4.56 liter per meter to 12.6 liter per meter. An influx of a certain magnitude would increase the level in the smaller capacity choke line to a higher level than the influx constitute in the openhole—drillstring annulus, hence an influx progressing would be stopped just by the higher hydrostatic pressure created by a higher liquid level 51 in the choke line 17.

DETAILED DESCRIPTION OF THE INVENTION

Figure 1A:
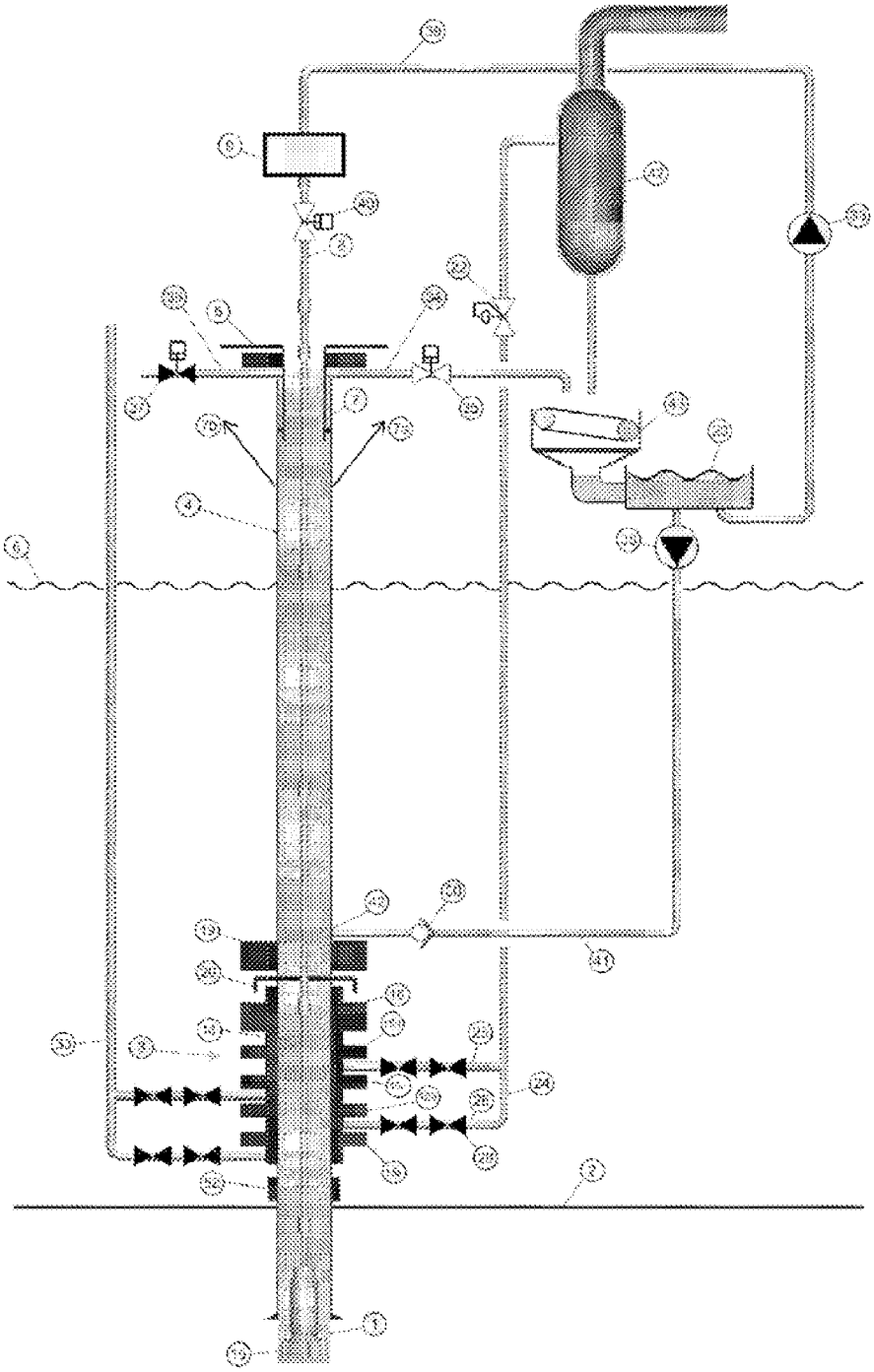
Figure 1a Prior Art
FIG. 1*a* illustrates a conventional subsea drilling system in normal drilling operations
Figure 1B:
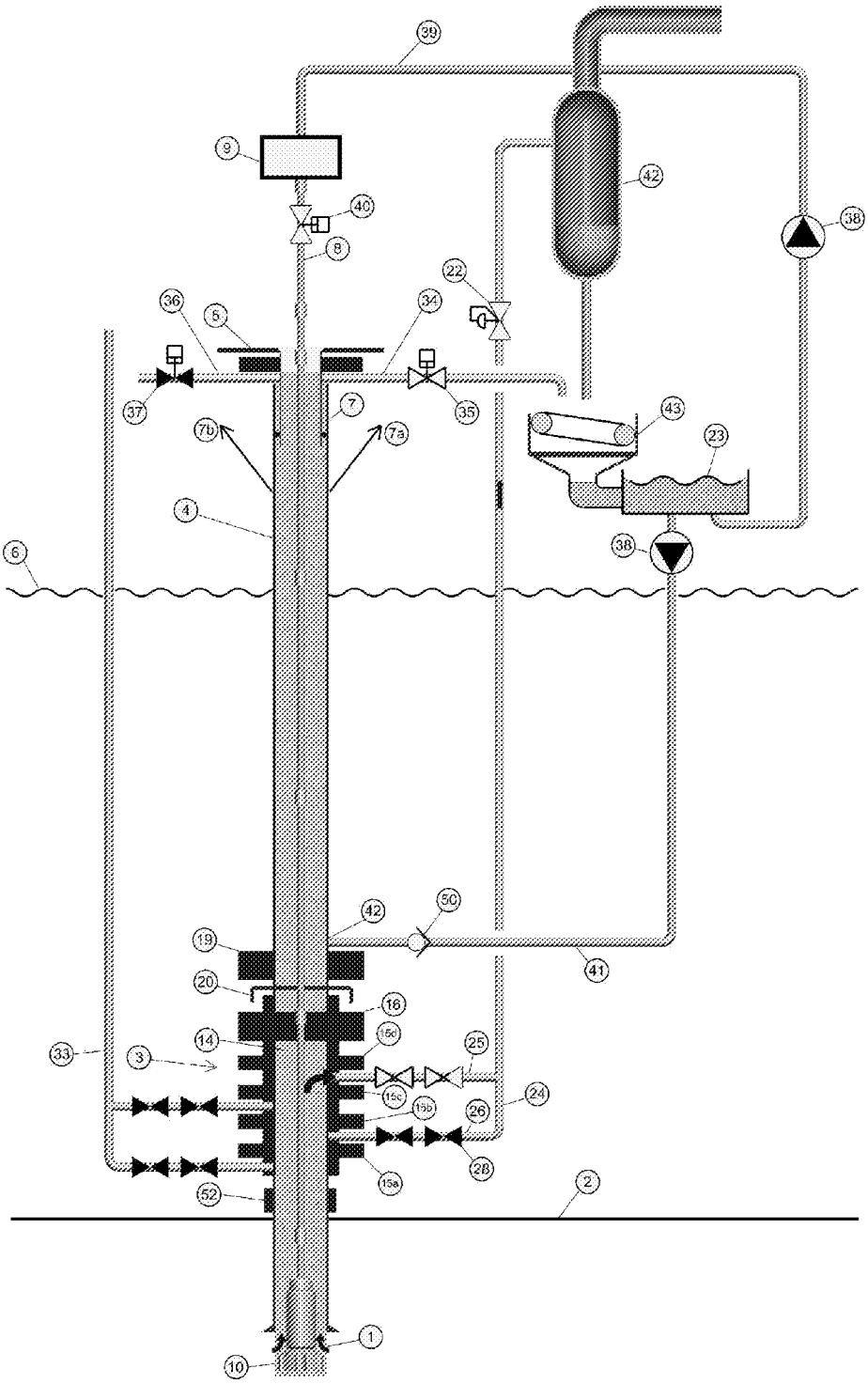
FIG. 1*b* illustrates conventional subsea drilling system in well control mode
Figure 2:
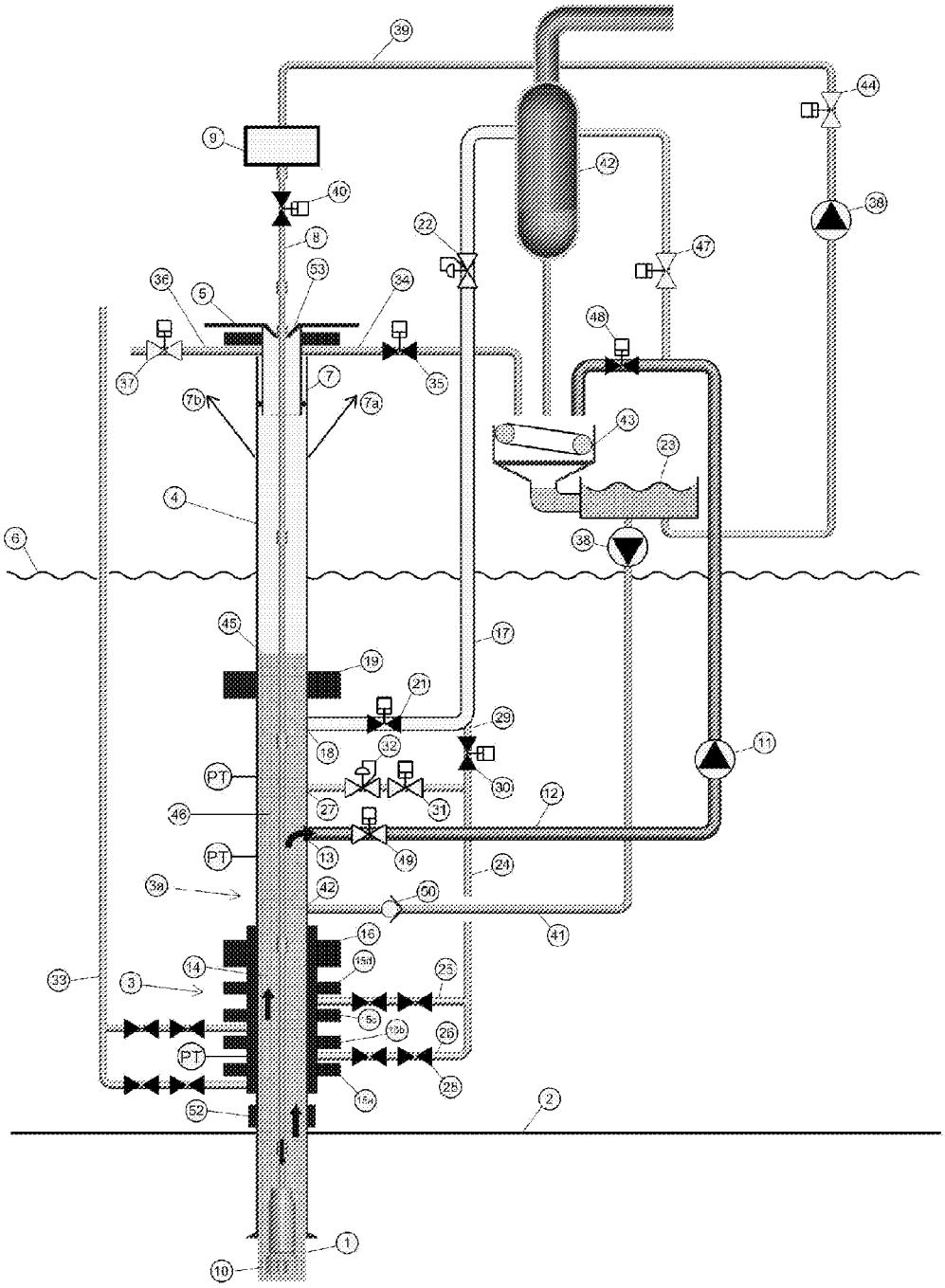
FIG. 2 illustrates a first embodiment of the present invention, including a riser, in drilling mode.

FIG. 2 illustrates a first embodiment of the subsea drilling system of the invention. It comprises a well having a well bore 1. The well bore may be partially cased. Above the seabed level 2 is arranged a subsea BOP 3 with a BOP extension joint 3*a* which is equipped with several pressure sensors and several inlets and outlets. A riser 4 is connected to the BOP and extends to a vessel 5 above the sea level 6. The riser 4 has a slip joint 7 to accommodating heave of the vessel 5 and a riser tensioning system 7*a*, 7*b*. Above the diverter housing and diverter outlet is a low pressure gas stripper installed 53 to prevent low pressure gas escaping to the drill floor of the drilling rig. The diverter line 36 is ventilated to the atmosphere or the mud gas separator (not shown). The flow line valve 35 is closed as the drilling fluid now is returned via the subsea pump 11 and return line 12.

Drill string 8 extends from a top drive 9 on the platform 5 and into the well bore 1. The lower end the drill string 8 is equipped with a drill bit 10.

A liquid return line 12 is connected to the BOP extension 3*a* at a first side port 13 and extends to the water surface. The liquid return line has a subsea lift pump 11 for aiding mud return to the surface vessel 5. The liquid return line has a valve 49 in the branch between the first side port 13 and the pump 11.

A gas return line 17 is also connected to the BOP 3 or BOP extension 3*a* by a second side port 18. The gas return line 17 extends to the water surface and drilling vessel 5. The gas return line has a first valve 21 close to the second side port 18 and a choke valve 22 near the water surface 6 or on the drilling unit. Both the liquid return line 12 and the gas return line 17 are at their upper ends connected to a collection tank 23 via a mud gas separator 42 on the drilling rig.

The BOP has a main bore 14 through witch the drill string 8 extends. A plurality of safety valves 15, rams 15*a*, 15 *b*, 15 *c*, are adapted to close the main bore 14 around the drilling tubular or to seal the wellbore completely 15*d*, to prevent a blow-out.

Above the safety valves 15 and below the first side port 13 the BOP 3 has a lower annular valve 16, which is adapted to close around the drilling tubulars 8.

The BOP has an upper annular valve 19 above the second side port 18. This annular valve may be a so-called rotating BOP, enabling drilling while the valve is closed.

A by-pass line 24 extends from the lower BOP (here two side ports 25 and 26 are shown) below the lower annular valve 16 to a third side port 27 between the first and the second side ports 13 and 18. The by-pass also has a branch 29 connecting to the gas return line 17 here defined as the gas line or choke line. The bypass line 24 has lower valves 28 to close off the lower part of the by-pass line 24, a first upper valve 30 to close off the branch 29 and a second upper valve 31 to close off the connection to the port 27. In addition, there is a choke valve 32 in this bypass line.

The system also has a kill line 33, which is also included in a conventional system.

At the top of the riser is a mudflow line 34 with a flow line valve 35 and a overboard line (diverter) 36 with a valve 37, which are also according to a conventional system.

As also according to a conventional system, there are several mud pumps 38 pumping mud from the collection tank 23 to the top drive 9 through a line 39. A valve 40 is included in the line 39 close to the top drive.

In addition, there is a booster line 41 extending from a mud pump 38 to a fourth side port 42 in the Lower Marine Riser Package or a circulating line connected below the first side port 13. The line 41 is equipped with at least 1 valve 50 close to the side port 42. This can be a backpressure valve and or a 2 way shut-off valve. This line may also be used to inject low density fluid or gas into the return path downstream the subsea choke valve installed close to the subsea BOP.

The system as described above in connection with FIG. 2 is basically the same for all the embodiments described hereinafter. In the following only the items deviating from the arrangement in FIG. 2 will be described in detail.

Figure 4:
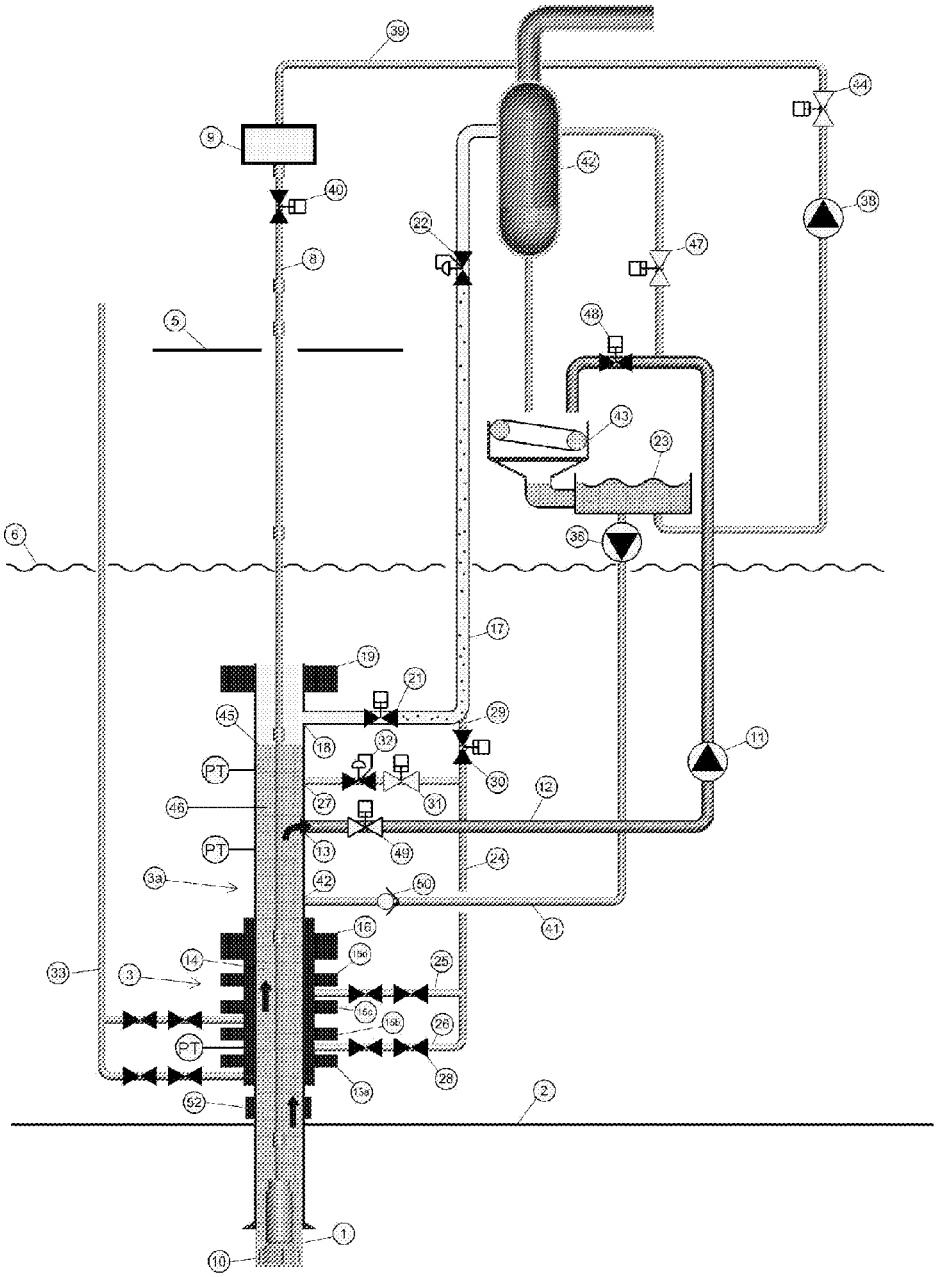
FIG. 4 illustrates a second riserless embodiment of the present invention in drilling mode.

The system of FIG. 2 can be used for drilling with and without marine drilling riser. FIG. 4 shows a system without a riser. Except for the lack of a riser, the system is identical with the system described in FIG. 2.

The operation of the system according to the invention will now be described:

FIG. 2 illustrates normal drilling mode of the system. During normal drilling with a riser, both the lower and upper annular valves 16, 19 in the BOP 3 are open. The mud level 45 in the BOP or BOP extension or riser is controlled using the subsea mud lift pump 11, which is hydraulically connected to the lower part of the BOP extension joint or riser. Any drill gas or background gas is vented off through the marine drilling riser, i.e. through the gas vent line 36. Suspended and small gas bubbles may for the most case follow the liquid mud phase into the pump system 11 and be pumped to the surface. At surface the returns can be directed to the shale shakers 43 directly or via a valve 47 to the mud gas separator 42. The system allows the mud level 45 to be adjusted for control of the bottom hole pressure. The fluid above the mud in the riser can be any type of liquid or gas, including air.

Figure 3:
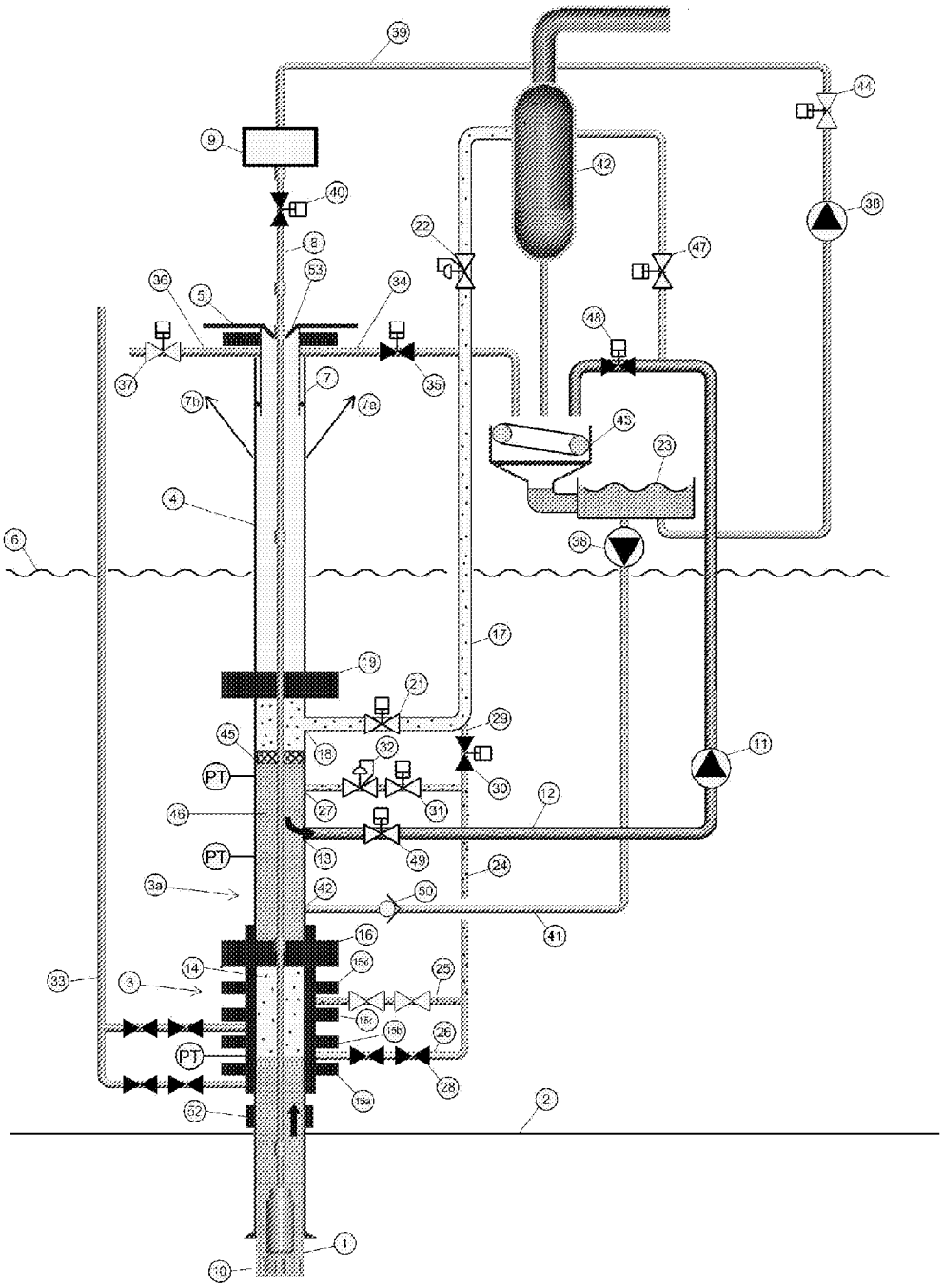
FIG. 3 illustrated the embodiment of FIG. 2 in well control mode.

FIG. 3 shows the system in a well control event. The drill string rotation is stopped and the lower and upper annular valves 16, 19 are closed. This creates a cavity 46 between the lower and upper annular valves 16, 19. The well fluid is diverted from below the lower annular valve 16 to below the upper annular valve 19, i.e. to within the cavity 46, through the bypass line 24 containing the choke valve 32. Separation of the fluids in the cavity 46 in the BOP extension joint will take place due to gravity. The outlet 13 to the subsea lift pump 11 is arranged below the inlet level 27 for the well fluid, and the gas is vented off to the surface through the choke or gas return line 17 connected to the outlet 18 located above the fluid inlet 27 from the well. Normally, the gas/liquid interface level 45 will be located below the level for the gas line 17. A surface choke 22 is used to control the pressure of the gas phase. The level 45 in the BOP cavity can be measured either by pressure transducers, gamma densitometries, sound, or other methods.

Figure 6:
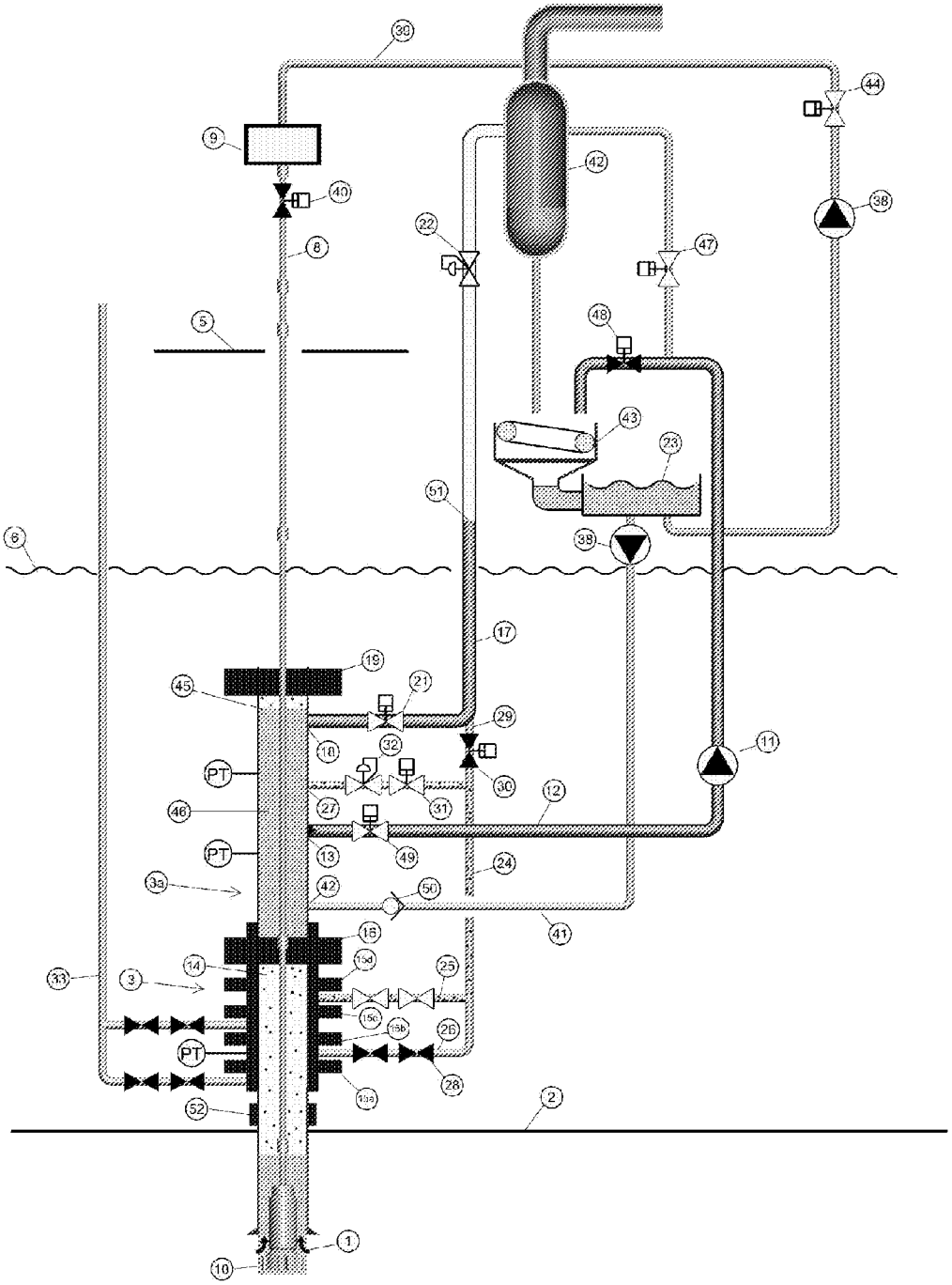
FIG. 6 illustrates the system of FIGS. 4 and 5 performing an alternative method for well control.

In this circulation and well pressure control method the surface drill pipe pressure can be regulated by regulating the subsea choke 32, the subsea pump 11 can be used to regulate the liquid level 45 in the BOP cavity and the pressure in the cavity can be regulated by the pressure in the surface choke 22, pressure in the BOP cavity, or the liquid level 51 in FIG. 6 (or combination of the two).

Figure 5:
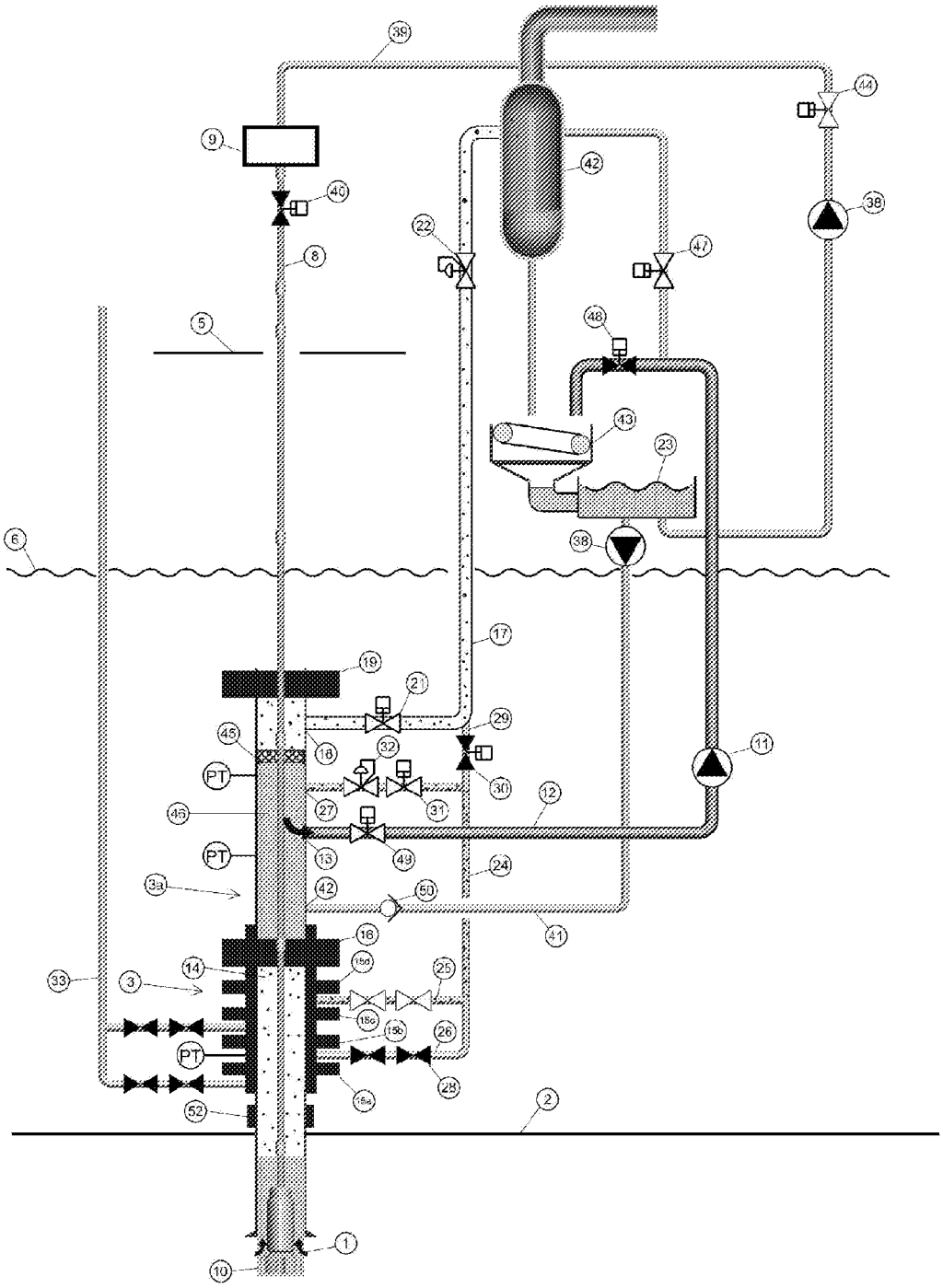
FIG. 5 illustrates the embodiment of FIG. 4 in well control mode.

FIGS. 4 and 5 show riserless drilling, and well control mode in riserless drilling, respectively.

During riserless drilling, the annular valves 16, 19 in the BOP 3 are open as illustrated in FIG. 4. The mud/sea water level 45 in the BOP 3 is controlled using the subsea mud lift pump 11 and pressure sensors in the extension joint 3*a* between the two annulars 16, 19. Any small amount of drill gas or background gas may escape to sea from the open top of the BOP extension. However, most of the drill gas will follow the return liquids through the pump system 11. In a well control event, the drill string 8 rotation is stopped and the lower and upper annular valves 16, 19 are closed, as illustrated in FIG. 5. The well fluid is diverted from below the lower annular 16 to below the upper annular valve 19 through the bypass line 24 containing the choke valve 32. The choke valve 32 will now control the bottom hole pressure and the pressure downstream the choke 32 will be much lower than the upstream pressure. This will improve the separation process.

Separation of the fluids in the BOP extension joint 3*a* will take place due to gravity. An outlet 13 to the subsea lift pump 11 is arranged below the inlet level 27 for well fluid, and any free gas is vented off to surface through the flexible or fixed choke line 17 to above the water surface. Normally, the gas/fluid level 45 will be located below the outlet level 18 for the vent line 17. A surface choke 22 is used to control the pressure of the gas phase.

FIG. 6 illustrates the subsea separator in an alternative mode. Here the subsea choke 32 is used to control bottom-hole pressure (BHP). The separator with the vent line 17 is used to remove the gas from the liquid before entering the subsea lift pump. However, the liquid is allowed to enter the vent line 17 and establish a liquid/gas interface 51 in the vent line 17. The head of this liquid column and any pressure above the liquid/gas interface defines the pressure in the separator cavity 46. By regulating the pressure above the fluid level and the level of the interface 51, the pressure in the cavity 46 can be adjusted as illustrated in FIG. 6.

The pressure in the cavity 46 can be increased by pumping mud from the surface through the boost line 41. This will quickly raise the interface 51 and hence increase the pressure in the cavity 46. The pressure in the cavity 46 can be lowered by increasing the pump rate of the subsea return pump 11. This will quickly reduce the level of the interface 51 and hence the pressure in the cavity 46. This provides a means for rapidly adjusting the pressure in the cavity 46 and hence the back pressure against the well fluid entering the cavity 46 from the by-pass line 24 if the choke is fully open.

In the case of a subsea pump failure or as an option, a low density fluid or gas may be injected into the return lines or choke line, downstream of the subsea choke valve, so as to keep the pressure immediately downstream the subsea choke valve 32 substantially lower than the pressure upstream the subsea choke valve. In this manner the well pressure can be controlled accurately by the subsea choke.

Means to Reduce Pressure Fluctuations:

In order to avoid slug flow and large pressure variations, a choke valve 32 can be used to control the flow of fluids into the separator 48 and avoid or reduce the pressure fluctuations. Pressure fluctuation downstream of the subsea choke valve 32 could also affect the upstream pressure of the subsea choke (well pressure). However, keeping the gas/fluid level within the separator allows large gas flow rates to the handled.

Increasing the diameter of the choke line (6-8 inches) allows the liquid to enter the vent line 17 and separate from the gas without excessive pressure fluctuation in the BOP cavity. Since a subsea choke valve reduces the pressure, a low pressure choke line may be used.

In an effective riserless subsea separation system, the liquid/gas interface level may be kept within the separator and a surface choke valve to control the separator pressure may be introduced.

When keeping the pressure in the separator equal to or just below the ambient seawater pressure, the normal drilling operations can be conducted without major adjustments to the separator pressure. With only gas in the choke line, the size can be reduced (2-3 inches). This system will also reduce the gas separated from the liquid before entering the subsea lift pump. The pressure will reduce the subsea pump differential pressure needed to bring the return fluid back to the drilling vessel. Gas bleed off may take place at high rates.

This means that the remaining gas still contained in the liquids has to be separated at surface. So, the gas from the choke line, and the mud and gas from the subsea lift pump can be diverted through the mud gas separator/Poor Boy degasser 42 and vented off through the vent line in the derrick.

The invention claimed is:

1. System for well control during drilling, completion, or well intervention of a subsea well, comprising:

a wellbore located in a seabed below seawater, said seawater extending to a water surface level, the wellbore having an annulus;

a subsea blow-out preventer (BOP) located on top of the wellbore;

a separator cavity established between a closed lower closing element and a closed upper closing element, said closing elements being situated in a part of the BOP and/or in a lower marine riser package (LMRP);

a bypass line extending from the wellbore to the separator cavity, said separator cavity being adapted to receive well fluid that is a mixture of liquid and gas via said bypass line, said bypass line having a fixed or adjustable bypass choke;

a gas return line extending from a gas return outlet in an upper part of said separator cavity;

a liquid return line extending from a liquid return outlet in a lower part of said separator cavity or from the wellbore annulus; and a lift pump configured to pump liquid through said liquid return line.

2. System according to claim 1, wherein the bypass line is connected to the separator cavity above the liquid return outlet.

3. System according to claim 1, wherein the bypass line is connected to the separator cavity below the gas return outlet.

4. System according to claim 1, wherein said gas return line has a gas return choke valve.

5. System according to claim 4, wherein said gas return choke valve is located near the water surface level.

6. System according to claim 1, wherein a pressure of the well fluid in the separator cavity is substantially equal to or lower than a pressure of the seawater at the seabed.

7. System according to claim 1, wherein the separator cavity is adapted to be opened for well flow directly from the wellbore annulus, and the liquid return line is connected to a liquid filled part of the annulus or separator cavity.

8. Method for well control during drilling, completion, or well intervention of a subsea well having a well bore located in a seabed below seawater, said seawater extending to a water surface level, the method comprising:

creating a separator cavity by closing an upper and a lower closing element, said closing elements being situated in a subsea BOP and/or lower marine riser package connected to the subsea well;

transferring well fluid from the well bore to the separator cavity via a bypass line fluidly connecting the well bore with the separator cavity;

separating gas from the well fluid in the separator cavity;

taking out liquid from a lower part of the separator cavity and evacuating the liquid to the water surface; and taking out gas from an upper part of the separator cavity and letting the gas flow to the water surface.

9. Method according to claim 8, wherein a pressure in the wellbore below the lower closing element is controlled by regulating a friction loss in the bypass line.

10. Method according to claim 8 wherein a pressure in the separator is controlled by regulating a pressure of the gas flowing to the water surface.

11. Method according to claim 8, wherein a liquid/gas interface in the separator cavity is regulated by a rate at which liquid is evacuated out of the lower part of the separator cavity.

12. Method according to claim 8, wherein the gas flows to the water surface via a gas return line and a pressure of the gas is reduced when the gas is taken out of the separator cavity.

13. The method to claim 8, further comprising connecting a riser above the separator cavity.

14. Method for well control during drilling, completion, or well intervention of a subsea well having a well bore located in a seabed below seawater, said seawater extending to a water surface level, the method comprising:

establishing a separator cavity in a subsea BOP and/or lower marine riser package;

establishing a choke return line from a choke return line outlet of said cavity;

establishing a liquid return line from a liquid return line outlet of said cavity, closing an upper closing element located above said choke return line outlet and the liquid return line outlet;

allowing a liquid/gas interface to establish in the choke return line;

using a hydrostatic liquid head of said liquid/gas interface and a gas pressure above the liquid/gas interface to control a pressure in the cavity; and taking out liquid from the wellbore and evacuating the liquid to the water surface via the liquid return line.

15. Method according to claim 14, wherein the choke return line has a substantially smaller diameter than the wellbore.

16. The method of claim 14 wherein establishing a separator cavity includes closing a lower closing element below the choke return line outlet and the liquid return line outlet, thereby creating said separator cavity between the lower and the upper closing elements, and providing a bypass connection from below the lower closing element to above the lower closing element.

17. The method of claim 16 wherein well fluids from the bypass connection enter the closed cavity above the liquid line outlet and below the choke line outlet.

18. The method of claim 16, wherein a pressure in the wellbore below the lower closing element is controlled by regulating a friction loss in the bypass connection.

19. The method of claim 18, further comprising pumping a fluid at a variable flow rate into the well below the lower closing element via a kill line.

20. The method of claim 14, wherein the gas pressure in the choke return line is adjustable.

21. Method according to claim 14, further comprising allowing the pressure in the cavity to substantially equalize with a pressure in the wellbore.

22. Method according to claim 14, further comprising injecting a low density fluid downstream of a choke valve into a line connecting the wellbore with the cavity, thereby keeping a pressure immediately downstream of the choke valve lower than a pressure upstream of the choke valve.

23. Method for well control during drilling, completion, or well intervention of a subsea well having a well bore located in a seabed below seawater, said seawater extending to a water surface, the method comprising:

creating a cavity by closing an upper and a lower closing element in a subsea BOP and/or lower marine riser package connected to the well;

taking out well fluid from the well via a bypass line fluidly connecting the well bore with the cavity, the well fluid being a mixture of liquid and gas;

injecting a low density fluid into the cavity from the water surface; and taking out the well fluid from an upper part of the cavity through a choke line to the water surface, thereby keeping a pressure in the cavity lower than a pressure in the well below the lower closed BOP element.

24. Method according to claim 23 wherein the pressure in the well below the lower closing element is controlled by regulating a friction loss in the bypass line.

25. Method according to claim 23 wherein the cavity pressure is controlled by regulating the pressure of the well fluid gas and liquid flowing to the water surface by a surface controlled choke.

26. Method according to claim 23 wherein the pressure in the well is controlled by a surface controlled choke valve in the bypass line.

* * * * *